US010709948B1

(12) United States Patent
Zimmer et al.

(10) Patent No.: US 10,709,948 B1
(45) Date of Patent: Jul. 14, 2020

(54) BASKETBALL SET

(71) Applicant: Custom-Pak, Inc., Clinton, IA (US)

(72) Inventors: Ronald A. Zimmer, Dewitt, IA (US); Steven Dean Eggers, Clinton, IA (US); Alan Walter Knapper, McCausland, IA (US)

(73) Assignee: Custom-Pak, Inc., Clinton, IA (US)

( * ) Notice: Subject to any disclaimer, the term of this patent is extended or adjusted under 35 U.S.C. 154(b) by 0 days.

(21) Appl. No.: 16/248,262

(22) Filed: Jan. 15, 2019

(51) Int. Cl.
*A63B 63/08* (2006.01)

(52) U.S. Cl.
CPC ..... *A63B 63/083* (2013.01); *A63B 2208/12* (2013.01); *A63B 2225/093* (2013.01)

(58) Field of Classification Search
CPC ..... A63B 63/083; A63B 2225/093; A63B 2208/12
See application file for complete search history.

(56) References Cited

U.S. PATENT DOCUMENTS 2,515,226 A * 7/1950 Horwitch ..... A63B 67/22 473/508
2,986,395 A * 5/1961 Sheftel ..... A63B 63/083 473/483
4,793,611 A * 12/1988 Thornell ..... A63B 63/083 16/343
5,082,261 A * 1/1992 Pelfrey ..... A63B 71/023 248/407
5,375,835 A * 12/1994 Van Nimwegen ... A63B 63/083 248/407
5,632,480 A * 5/1997 Davis ..... A63B 71/023 248/161
5,713,806 A * 2/1998 Teitgen ..... A63B 71/0054 473/481
6,027,435 A 2/2000 Nadorf et al.

OTHER PUBLICATIONS

U.S. Appl. No. 15/992,792 Title: Net Attachment System Inventors: Steven Dean Eggers Filed: May 30, 2018.

* cited by examiner

*Primary Examiner* — Jeffrey S Vanderveen
(74) *Attorney, Agent, or Firm* — St. Onge Steward Johnston & Reens, LLC

(57) ABSTRACT

A blow molded basketball goal having an inner post, an outer post, a rim, and a backboard. The inner post having a top end, a bottom end, a length measured from the top end to the bottom end, and a plurality of protrusions positioned near the bottom end. The outer post having a bottom end, a hollow interior defined by an interior wall, an open top end adapted to receive the inner post, and at least one protuberance on the interior wall. When the inner post is received in the outer post, the plurality of protrusions of the inner post bear against the interior wall of the outer post and the at least one protuberance of the outer post bears against the inner post. The rim is securable to the inner post, and the backboard is securable to the rim.

22 Claims, 10 Drawing Sheets

BASKETBALL SET

FIELD OF THE INVENTION

The invention relates to basketball sets and more particularly blow molded youth basketball sets.

BACKGROUND OF THE INVENTION

Plastic youth basketball sets are well known in the art. However, these basketball sets suffer from disadvantages that can affect the assembly, durability, and performance of the basketball sets.

The known plastic youth basketball sets are height adjustable through manually raising or lowering the post. However, these posts require the user to simultaneously hold the post at the desired height and lock the post in place at that height. Additionally, many of these posts do not provide for variable positioning while retaining a rigid and upright stance without the use of additional components. The posts that do not rely on additional components result in a post that bends or leans when extended. Also, these known posts generally lack a locking feature that can withstand the intense downward forces of the popular "slam-dunk," potentially causing damage to the basketball set and injury to the users.

Furthermore, these known plastic youth basketball sets lack the corner guards featured on professional basketball sets. The corner guards are generally made of softer materials to protect the users and provide a more decorative, professional look.

Therefore, there is a need for a durable plastic youth basketball set that can hold itself in a rigid, upright position and includes safety features such as a sturdy height position locking system and soft backboard corner guards.

SUMMARY OF THE INVENTION

Accordingly, embodiments of the present invention include devices and kits for assembling a blow molded basketball set. As used herein, the terms "first" and "second" are used to distinguish one element, set, object, or thing from another, and are not used to designate relative position or arrangement in time.

In one embodiment of the present invention, a blow molded basketball goal including an inner post, an outer post, a rim, and a backboard is provided. The inner post has a top end, a bottom end, a length measured from the top end to the bottom end, and a plurality of protrusions positioned near the bottom end of the inner post. The outer post has a bottom end, a hollow interior defined by an interior wall, an open top end adapted to receive the inner post, and at least one protuberance on the interior wall. When the inner post is received in the outer post, the plurality of protrusions of the inner post bear against the interior wall of the outer post and the at least one protuberance of the outer post bears against the inner post. The rim is securable to the inner post, and the backboard is securable to the rim.

In some embodiments, the inner post also includes a plurality of recesses in a side of the inner post arranged along the length of the inner post. Each of the plurality of recesses is defined by at least a bottom upward-angled surface and a top surface.

In some embodiments, the outer post also includes a latch having a pivot hinge and a projection. The projection corresponds to the plurality of recesses of the inner post such that the projection can be fit into any of the plurality of recesses of the inner post to lock the inner post in the outer post at a desired height.

In some embodiments, the inner post also includes a plurality of tapered protrusions and a stepped collar. The plurality of tapered protrusions are positioned near the top end of the inner post. The stepped collar has a lower step configured to support a portion of the backboard, and an upper step configured to limit the positioning of the rim when securing the rim to the inner post. Also, the stepped collar is positioned between the plurality of tapered protrusions and an upper-most recess of the plurality of recesses.

In some embodiments, the rim has a rear section and a front section. The rear section has a first hole adapted to receive the top end of the inner post. The first hole is defined by a first wall having a plurality of tapered recesses corresponding to the plurality of tapered protrusions of the inner post such that the protrusions bear against the recesses to secure the rim to the inner post. The front section has a second hole defined by a second wall having a plurality of voids and clips adapted to secure a flexible elongate material to the rim. When the rim is secured to the inner post, the upper step of the stepped collar bears against a bottom surface of the rear section of the rim such that the rim does not move down the length of the inner post when force is applied to the rim.

In some embodiments, the backboard includes an opening adapted to receive a portion of the rim such that the backboard does not interfere with securing the rim to the inner post. When the rim is received through the opening of the backboard and secured to the inner post, a bottom surface of the backboard bears against a collar of the inner post such that the backboard does not move down the length of the inner post when force is applied to the backboard.

In some embodiments, the backboard includes at least one removable corner member having a vertical section and a horizontal section. The horizontal section has at least one retaining bar for insertion into a corresponding slot in a corner of the backboard. The vertical section has at least one tab for insertion into a corresponding recess in the corner of the backboard.

In some embodiments, the basketball goal also includes a base having an opening to receive the bottom end of the outer post. The opening is defined by a wall having a plurality of tapered recesses corresponding to a plurality of tapered protrusions of the outer post positioned near the bottom end of the outer post. The protrusions bear against the recesses to secure the outer post to the base.

In an alternative embodiment of the present invention, a kit for assembling a blow molded basketball goal including an inner post, an outer post, a rim, and a backboard is provided. The inner post has a top end, a bottom end, a length measured from the top end to the bottom end, a plurality of protrusions positioned near the bottom end of the inner post, and a plurality of recesses arranged along the length of the inner post. Each of the plurality of recesses is defined by at least a bottom upward-angled surface and a top surface. The outer post has a bottom end, a hollow interior defined by an interior wall, an open top end adapted to receive the inner post, at least one protuberance on the interior wall, and a latch having a pivot hinge and a projection. When the inner post is received in the outer post, the plurality of protrusions of the inner post bear against the interior wall of the outer post and the at least one protuberance of the outer post bears against the inner post. The projection of the latch corresponds to the plurality of recesses of the inner post such that the projection can be fit into any of the plurality of recesses of the inner post to lock the inner post in the outer post at a desired height. The rim is securable to the inner post, and the backboard is securable to the rim.

In some embodiments, the inner post also includes a plurality of tapered protrusions positioned near the top end, and a stepped collar positioned between the plurality of tapered protrusions and an upper-most recess of the plurality of recesses. The stepped collar has a lower step configured to support a portion of the backboard, and an upper step defining configured to limit positioning of the rim when securing the rim to the inner post.

In some embodiments, the rim has a rear section and a front section. The rear section has a first hole adapted to receive the top end of the inner post. The first hole is defined by a first wall having a plurality of tapered recesses corresponding to the plurality of tapered protrusions of the inner post such that the protrusions bear against the recesses to secure the rim to the inner post. The front section has a second hole defined by a second wall having a plurality of voids and clips adapted to secure a flexible elongate material to the rim. When the rim is secured to the inner post, the upper step of the stepped collar bears against a bottom surface of the rear section of the rim such that the rim does not move down the length of the inner post when force is applied to the rim.

In some embodiments, the backboard includes an opening adapted to receive a portion of the rim such that the backboard does not interfere with securing the rim to the inner post. When the rim is received through the opening of the backboard and secured to the inner post, a bottom surface of the backboard bears against a collar of the inner post such that the backboard does not move down the length of the inner post when force is applied to the backboard.

In some embodiments, the backboard includes at least one removable corner member having a vertical section and a horizontal section. The horizontal section has at least one retaining bar for insertion into a corresponding slot in a corner of the backboard. The vertical section has at least one tab for insertion into a corresponding recess in the corner of the backboard.

In some embodiments, the kit also includes a base having an opening to receive the bottom end of the outer post. The opening of the base is defined by a wall having a plurality of tapered recesses corresponding to a plurality of tapered protrusions of the outer post positioned near the bottom end of the outer post. The protrusions bear against the recesses to secure the outer post to the base.

In another embodiment of the present invention, a height adjustable post adapted to secure to a base is provided. The post includes a blow molded inner member and a blow molded outer member. The inner member has a top end, a bottom end, a length measured from the top end to the bottom end, and a plurality of protrusions positioned near the bottom end of the inner member. The outer member has a bottom end, an open top end adapted to receive the inner member, a hollow interior defined by an interior wall, and at least one protuberance on the interior wall. When the inner member is received in the outer member, the plurality of protrusions bear against the interior wall of the outer member and the at least one protuberance bears against the inner member.

In some embodiments, the inner member also includes a plurality of recesses arranged along the length of the inner member. In other embodiments, the outer member also includes a latch having a pivot hinge and a projection. The projection of the latch interacts with the plurality of recesses of the inner member such that the projection can be pivoted into any of the plurality of recesses of the inner member to secure the post at a desired height.

In some embodiments, the inner member also includes a plurality of tapered protrusions positioned near the top end, and a collar positioned between the plurality of tapered protrusions and an upper-most recess of the plurality of recesses. The collar is configured to support a backboard assembly and prevent the backboard assembly from moving down the length of the inner member when force is applied to the backboard assembly.

In some embodiments, the backboard assembly includes a blow molded rim and a blow molded backboard. The rim includes a rear section and a front section. The rear section has a first hole adapted to receive the top end of the inner member. The first hole is defined by a first wall having a plurality of tapered recesses corresponding to the plurality of tapered protrusions of the inner member such that the protrusions bear against the recesses to secure the backboard assembly to the post. The front section has a second hole defined by a second wall having a plurality of voids and clips adapted to secure a flexible elongate material to the rim. The backboard includes an opening and at least two removable corner members. The opening is adapted to receive a portion of the rear section of the rim such that the backboard does not interfere with receiving the top end of the inner member through the first hole of the rim. Each of the at least two removable corner members has a vertical section and a horizontal section. The horizontal section has at least one retaining bar for insertion into a corresponding slot in a corner of the backboard. The vertical section has at least one tab for insertion into a corresponding recess in the corner of the backboard.

In some embodiments, the base includes an opening to receive the bottom end of the outer member. The opening of the base is defined by a wall having a plurality of tapered recesses corresponding to a plurality of tapered protrusions of the outer member positioned near the bottom end of the outer member. The protrusions bear against the recesses to secure the post to the base.

DETAILED DESCRIPTION OF THE INVENTION

Figure 1:
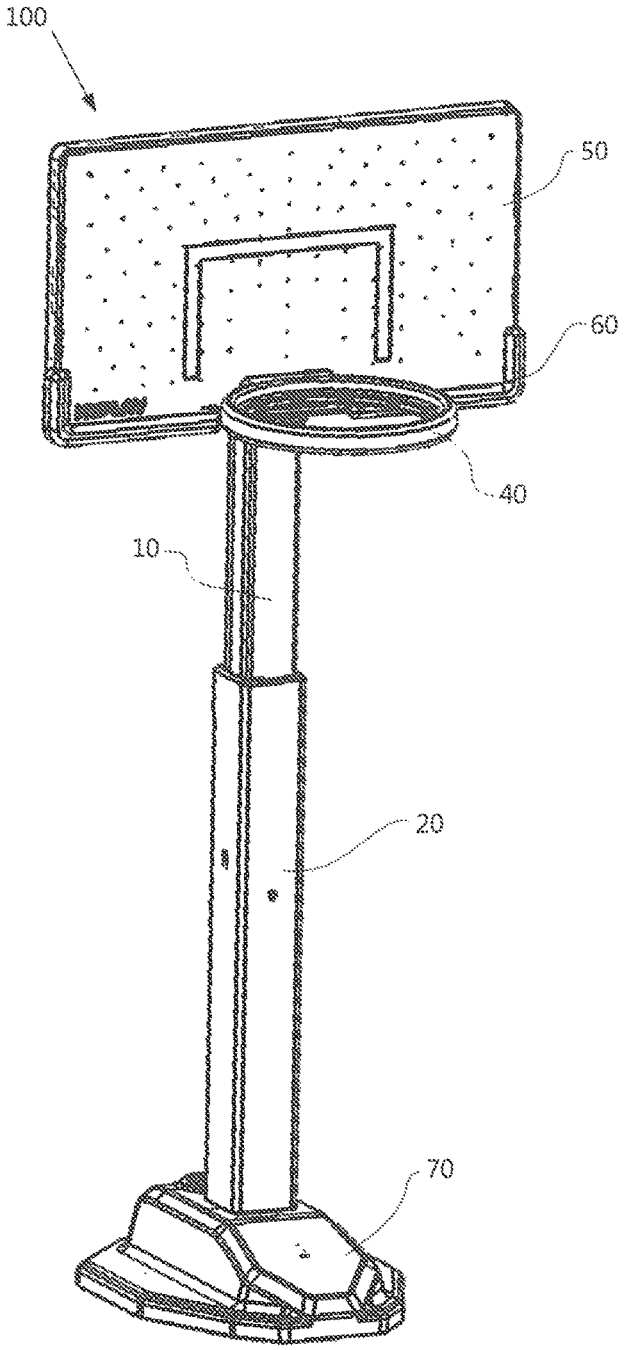
FIG. 1 is a front perspective view of a basketball set according to an embodiment of the present invention.

Referring now to the drawings, wherein like reference numerals designate corresponding structure throughout the views. The following examples are presented to further illustrate and explain the present invention and should not be taken as limiting in any regard.

Figure 2:
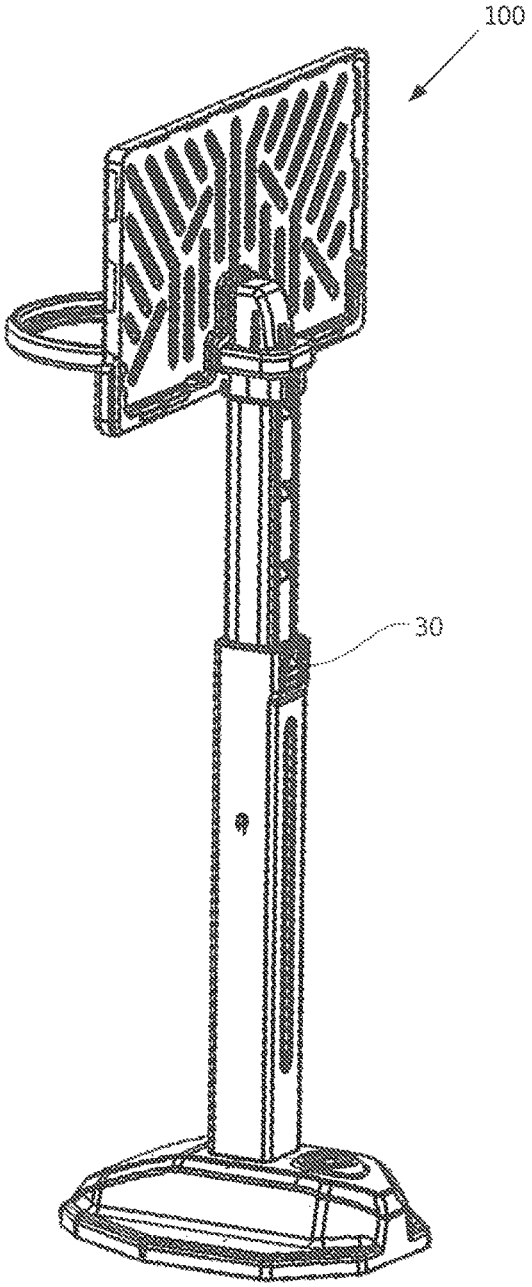
FIG. 2 is a rear perspective view of the basketball set of FIG. 1.
Figure 3:
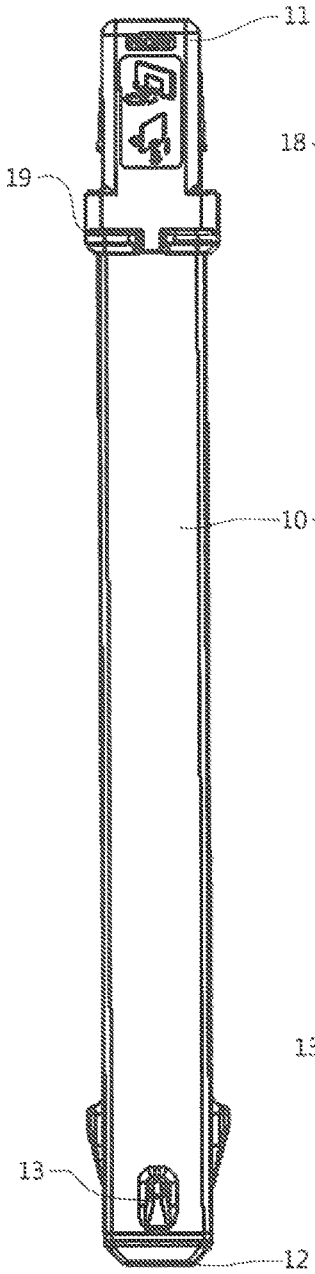
FIG. 3 is a front view of the inner post member of the basketball set of FIG. 1.
Figure 4:
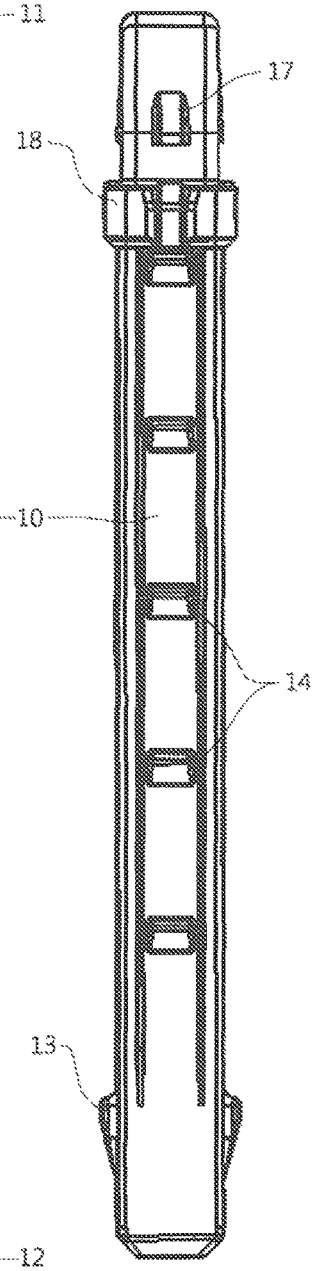
FIG. 4 is a rear view of the inner post member of FIG. 3.
Figure 5:
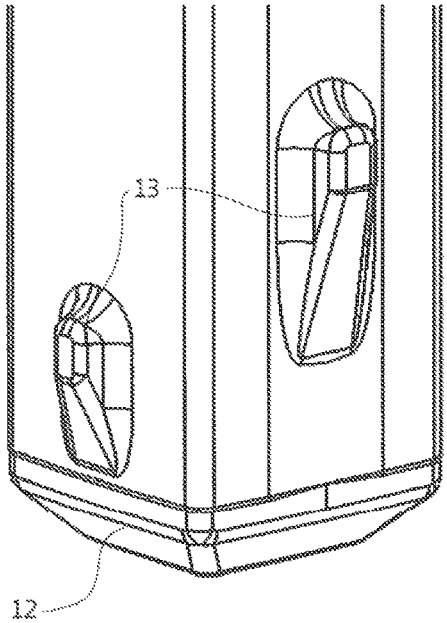
FIG. 5 is a close-up side perspective view of the inner post member of FIG. 3.

FIGS. 1-2 shows an assembled basketball set 100 having an inner post 10, an outer post 20, a rim 40, a backboard 50, and a base 70. These parts are secured together to create a basketball goal. As depicted in FIGS. 3-4, the inner post 10 has a top end 11 and a bottom end 12. In preferred embodiments, the inner post 10 has a plurality of protrusions 13 located near the bottom end 12. As seen in FIG. 5, the plurality of protrusions 13 preferably have a tapered shape and each protrusion faces a different direction perpendicular to the length of the inner post 10 measured from the top end 11 to the bottom end 12. Although the figures show the inner post 10 and outer post 20 shaped with generally rectangular cross-sections, the invention contemplates the use of posts with any other shaped cross-section, such as cylindrical, hexagonal, and the like.

Figure 7:
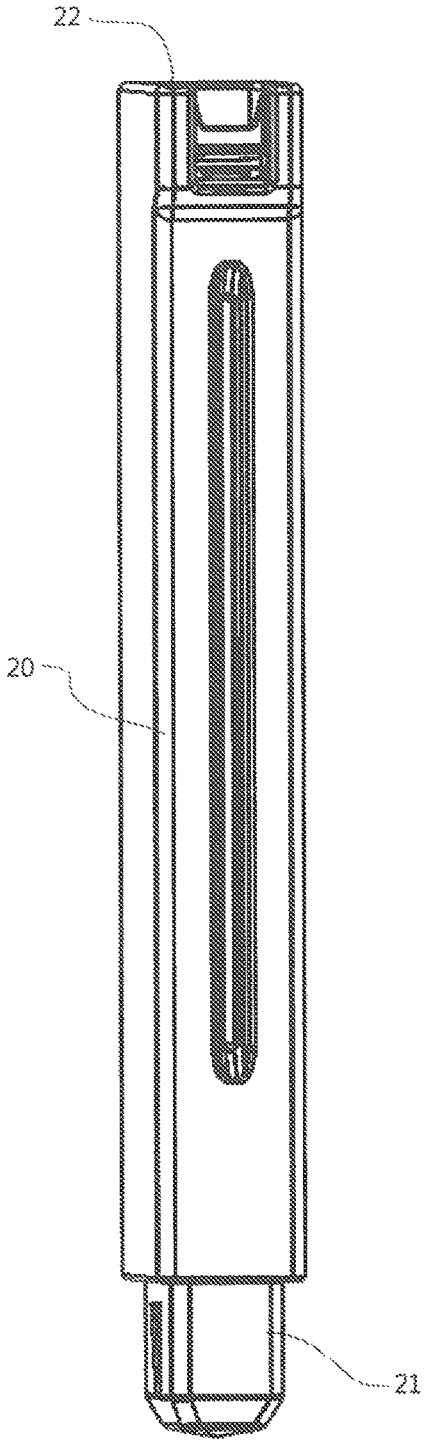
FIG. 7 is a rear perspective view of the outer post member of the basketball set of FIG. 1.
Figure 8:
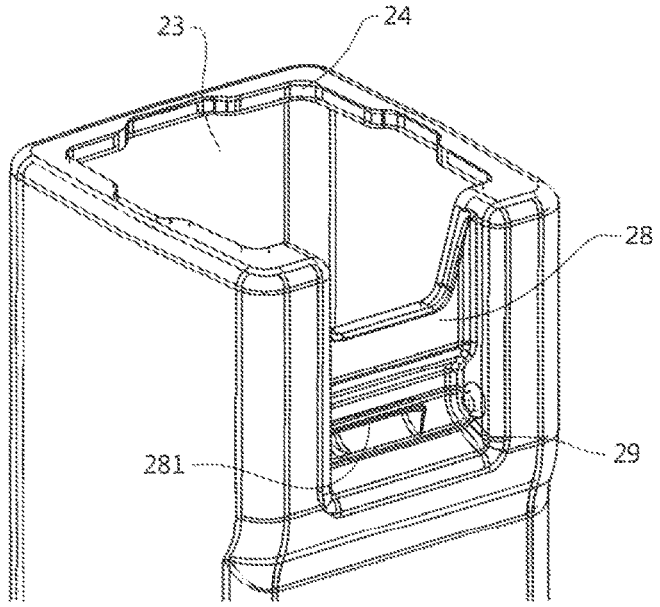
FIG. 8 is a close-up view of the top open end of the outer post member of FIG. 7.

As shown in FIG. 7, the outer post 20 preferably has a bottom end 21 and a top open end 22. FIG. 8 shows that the outer post 20 has a cavity/hollow-interior 23 accessible through the open end 22 that is configured to receive the inner post 10. The cavity 23 is generally defined by a lip 24, an exterior wall 25, and an interior wall 26. The lip 24 includes a plurality of depressions designed to permit the plurality of protrusions 13 to pass through as the inner post 10 is inserted into the cavity 23. The areas between the plurality of depressions on the lip 24 are preferably configured to remain in constant contact with the inner post 10 such that the top end 22 of the outer post 20 is always stabilizing a portion of the inner post 10.

Figure 9:
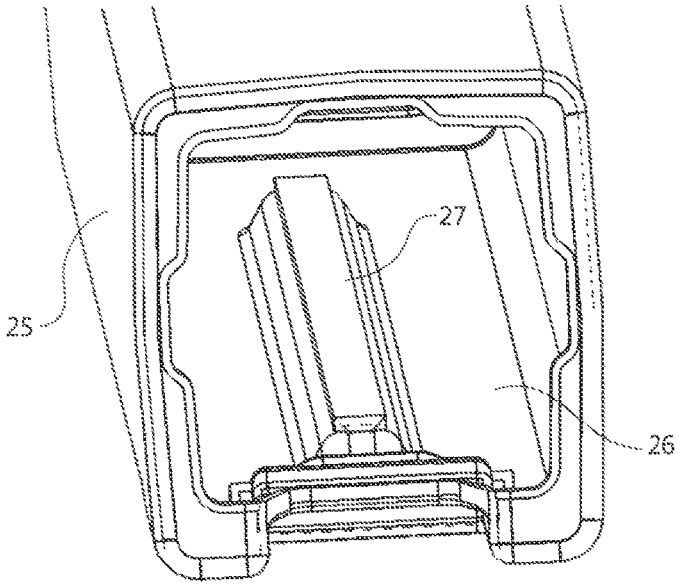
FIG. 9 is a top perspective view of the outer post member of FIG. 7.

In preferred embodiments, the outer post 20 also includes at least one protuberance 27 located on the interior wall 26 within the cavity 23, as depicted in FIG. 9. Preferably, the protuberance 27 is elongated and spans at least 60% of a length of the outer post 20 measured from the top end 22 to the bottom end 21. The protuberance 27 is configured to bear against a surface of the inner post 10 between two of the plurality of protrusions 13 when the inner post 10 is inserted into the cavity 23. Simultaneously, each of the plurality of protrusions 13 are configured to bear against the interior wall 26 when the inner post 10 is inserted into the cavity 23. Thus, the frictional forces of the protuberance 27 against the inner post 10 and the plurality of protrusions 13 against the interior wall 26 are preferably great enough to overcome the force of gravity, preventing the assembled basketball goal from free-falling while a user changes the height of the rim 40. Additionally, these frictional forces minimize distortion of the top end 22 of the outer post 20 during assembly, and minimize any tilt angle between the inner post 10 and the outer post 20, resulting in a basketball set 100 with a strong upright position.

Figure 6:
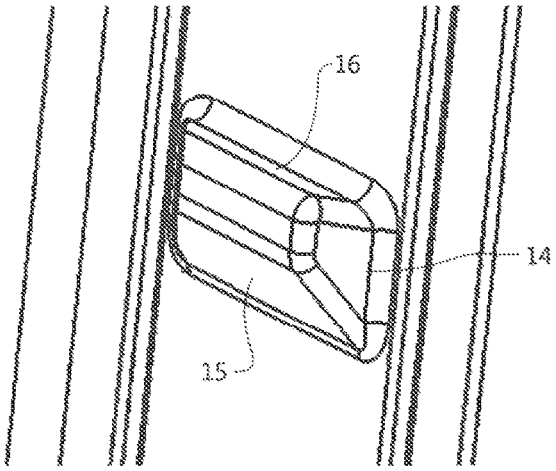
FIG. 6 is a close-up view of one of the plurality of recesses of the inner post member of FIG. 4.
Figure 12:
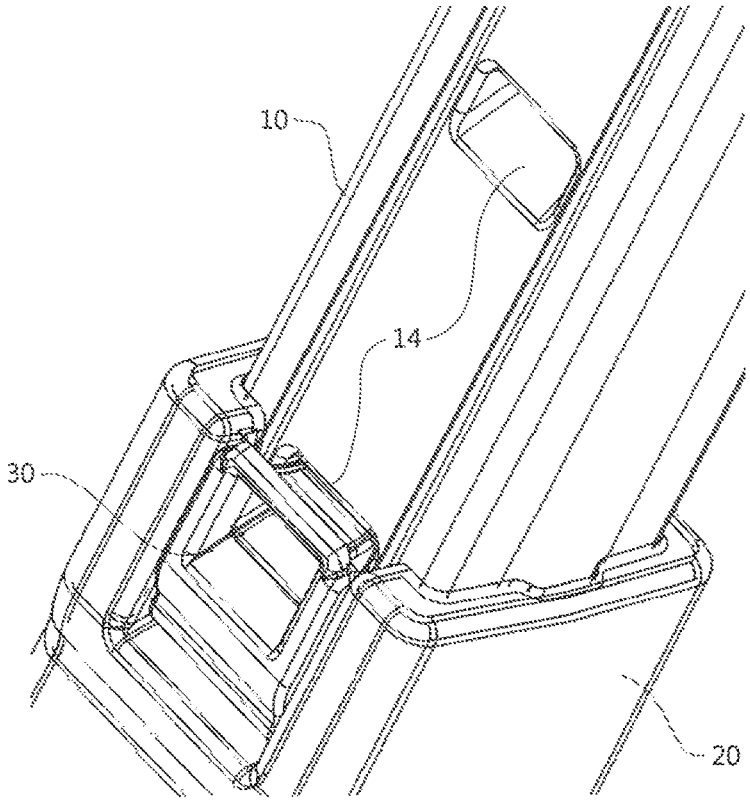
FIG. 12 is a close-up perspective view of the locking latch member of FIG. 10 inserted into the recess of FIG. 6 to secure the inner post member to the outer post member.

Preferably, the inner post 10 also includes a plurality of recesses 14 arranged in-line along at least 60% of the length of the inner post 10, as shown in FIG. 4. Each of the plurality of recesses 14 are defined by at least a bottom surface 15 and a top surface 16, as depicted in FIG. 6. The bottom surface 15 is angled-upward in the range of about 20 degrees to about 70 degrees from an axis perpendicular to the length of the inner post 10, and preferably about 45 degrees from the axis. The top surface 16 is preferably horizontal and generally parallel to the axis. The plurality of recesses 14 are configured to receive a latch 30 of the outer post 20 to secure the inner post 10 to the outer post 20 at a desired height, as shown in FIG. 12.

Figure 10:
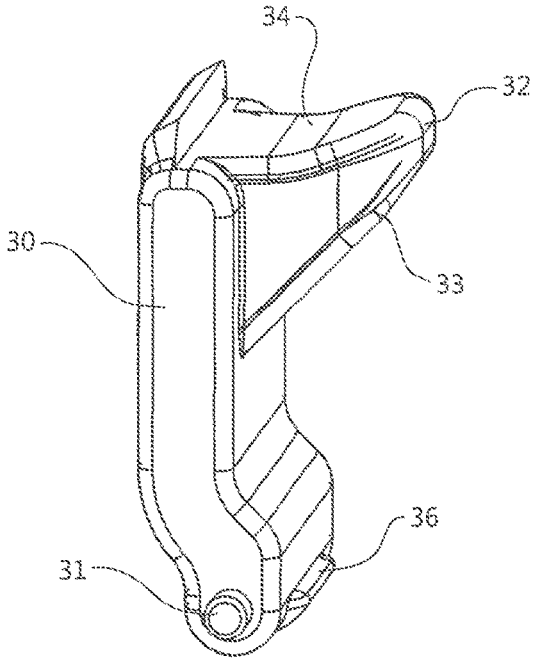
FIG. 10 is a side perspective view of the locking latch member of the basketball set of FIG. 2.
Figure 11:
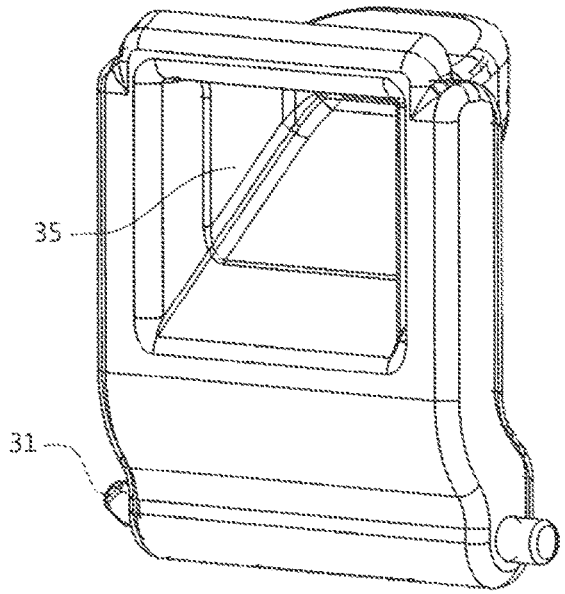
FIG. 11 is rear perspective view of the locking latch member of FIG. 10.

In preferred embodiments, the latch 30 includes knobs 31 positioned near the bottom and on opposing sides of the latch 30, as depicted in FIGS. 10-11. FIG. 8 shows that the outer post 20 includes a niche 28 adjacent to the lip 24 for housing the latch 30. Niche 28 has opposing holes 29 that correspond to the knobs 31, such that when the latch 30 is installed in the niche 28, the knobs 31 and the holes 29 interact to form a pivot hinge permitting the latch 30 to pivot about an axis connecting the holes 29.

The latch 30 also has a projection 32 positioned near the top of the latch 30. The projection 32 preferably has a bottom surface 33 and a top surface 34 that correspond to the bottom surface 15 and the top surface 16 of the plurality of recesses 14 of the inner post 10 such that the projection 32 can be inserted into any of the plurality of recesses 14 by pivoting the latch 30 to align the projection 32 with one of the recesses 14. When the projection 32 is fitted into a recess 14, the generally horizontal top surfaces 16/34 bear against each other to prevent any downward movement of the assembled basketball set 100. The upward-angled bottom surfaces 15/33 simplify disengaging the latch 30 when a user wants to adjust the height of the rim 40. Preferably, the latch 30 also includes an aperture 35 that extends at least partially into the rear of the projection 32, as depicted in FIG. 11. The aperture 35 serves as a finger-hold permitting a user to easily manipulate the latch 30. Thus, to disengage the latch 30 from a recess 14, the user applies upward force to the inner post 10 and pulls the projection 32 out of the recess 14 by utilizing the aperture 35.

In some embodiments, the latch 30 also has a notch 36 located between the knobs 31 on the same side of the latch 30 as the projection 32. Preferably, when the latch 30 is pivoted to the closed, or locked, position, the notch 36 snaps into a corresponding slot 281 of the niche 28. When snap-fitted into the slot 281, the notch 36 resists pivoting of the latch 30 and further strengthens the locking of the inner post 10 to the outer post 20.

Figure 13:
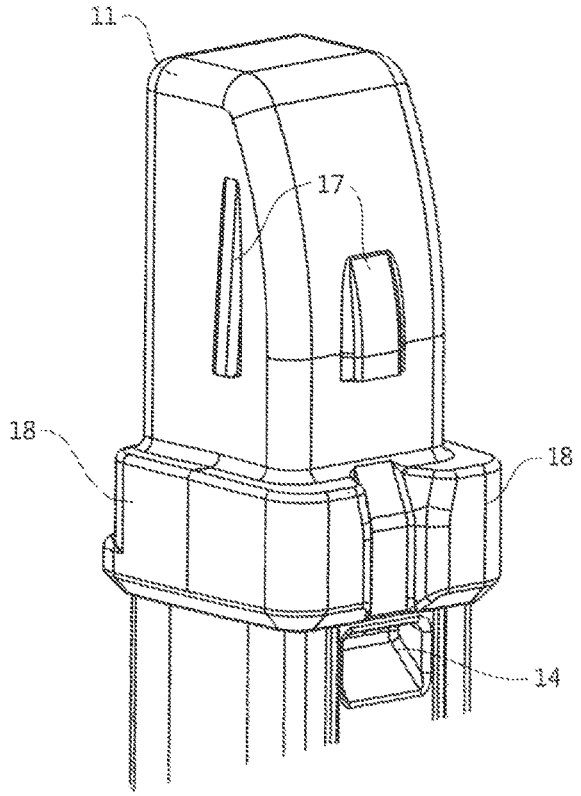
FIG. 13 is a close-up rear perspective view of the top end of the inner post member of FIG. 4.
Figure 14:
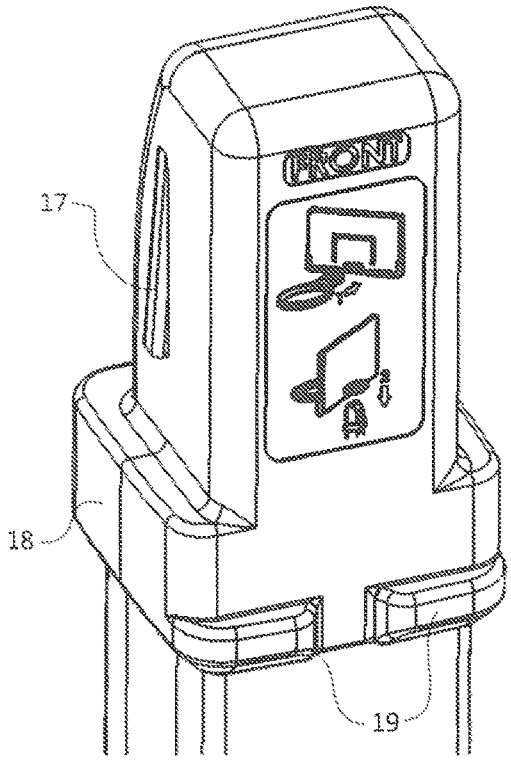
FIG. 14 is a close-up front perspective view of the top end of the inner post member of FIG. 3.

In preferred embodiments, the inner post 10 also includes a plurality of tapered protrusions 17 positioned near the top end 11. As seen in FIGS. 13-14, each of the plurality of tapered protrusions 17 preferably faces a different direction perpendicular to the length of the inner post 10. The inner post 10 also has a collar 18 located below the plurality of tapered protrusions 17, but above a top-most one of the plurality of recesses 14. In preferred embodiments, the collar 18 is stepped such that it has a lower level 19 that is configured to support a bottom surface of the backboard 50, and an upper level that is configured to both support a bottom surface of the rim 40 and to limit the positioning of the rim 40 when the rim 40 is secured to the inner post 10. In some embodiments, the collar 18 is not stepped and only supports/limits the positioning of the rim 40 on the inner post 10.

Figure 15:
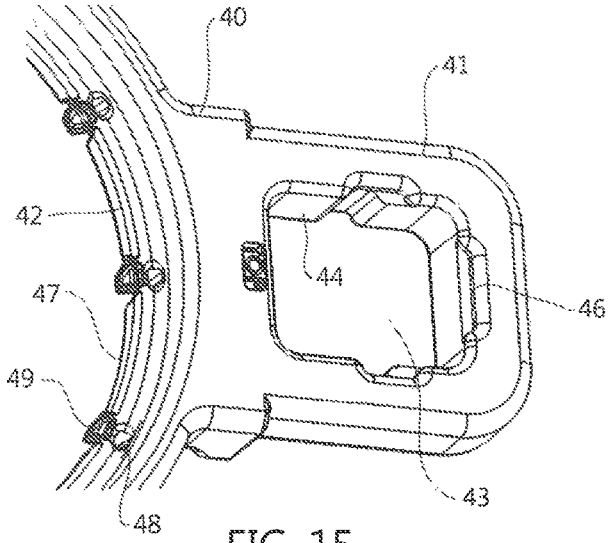
FIG. 15 is a top perspective view of the rear section of the rim of the basketball set of FIG. 1.
Figure 21:
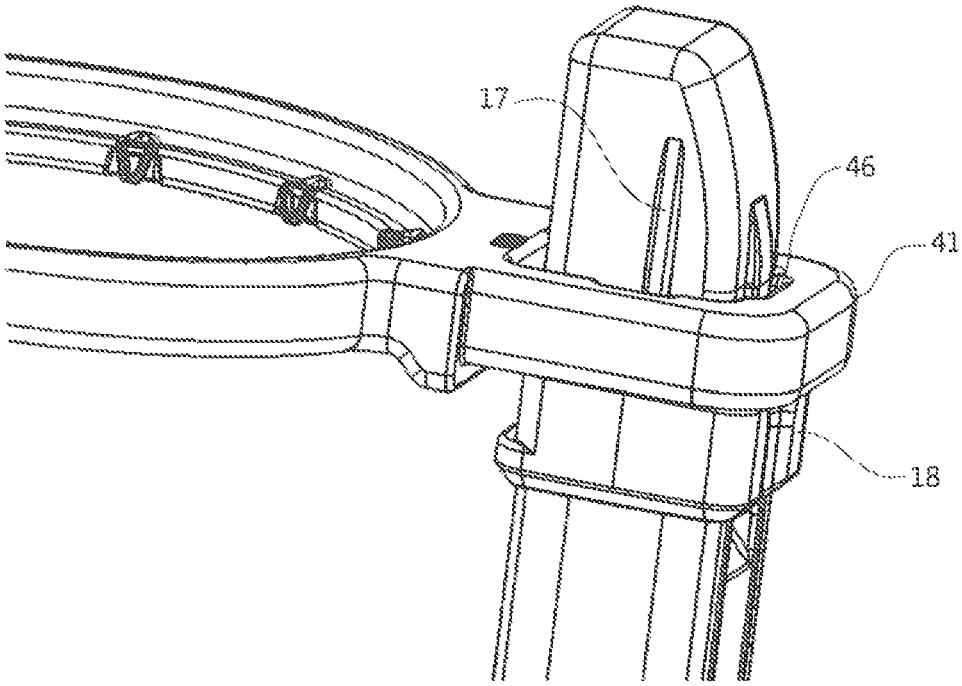
FIG. 21 is a side perspective view of the rim of FIG. 15 secured to the inner post member of FIG. 3.

The rim 40 is configured to be removably secured to the inner post 10. Preferably, the rim 40 has a rear section 41 and a front section 42, as shown in FIG. 15. The rear section 41 includes a hole 43 adapted to receive the top end 11 of the inner post 10. The hole 43 is defined by a wall 44 having a plurality of recesses 45 that correspond to the plurality of tapered protrusions 17 of the inner post 10. In preferred embodiments, each of the plurality of recesses 45 has a top flange 46. After the rim 40 is attached to the inner post 10, a bottom surface of the plurality of tapered protrusions 17 rests on each of the top flanges 46 to resist upward movement of the rim 40, as depicted in FIG. 21. Also, when the rim 40 is attached to the inner post 10, the upper level of the collar 18 bears against a bottom surface of the rear section 41 to resist downward movement of the rim 40.

The front section 42 of the rim 40 preferably includes a hole defined by a circular wall 47 having attachment means for securing a flexible elongate material, such as a net, to the front section 42 to form a basketball hoop. In preferred embodiments, the attachment means are a plurality of voids 48 and a plurality of clips 49 of the like disclosed in U.S. patent application Ser. No. 15/992,792, the contents of which are incorporated herein by reference. In other embodiments, the attachment means use any system known in the art, such as a plurality of J-hooks.

Figure 16:
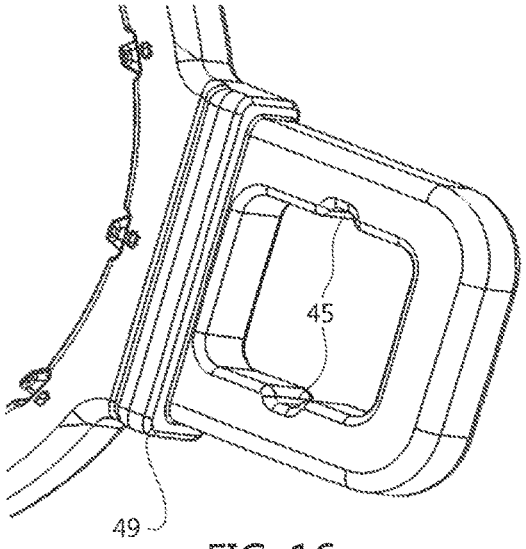
FIG. 16 is a bottom perspective view of the rear section of the rim of FIG. 15.
Figure 19:
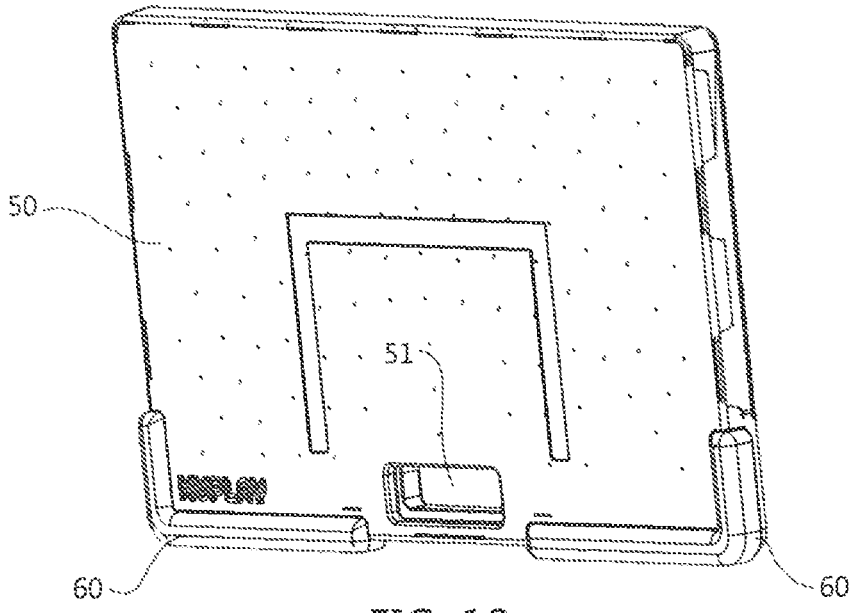
FIG. 19 is a front perspective view of the backboard of the basketball set of FIG. 1.
Figure 20:
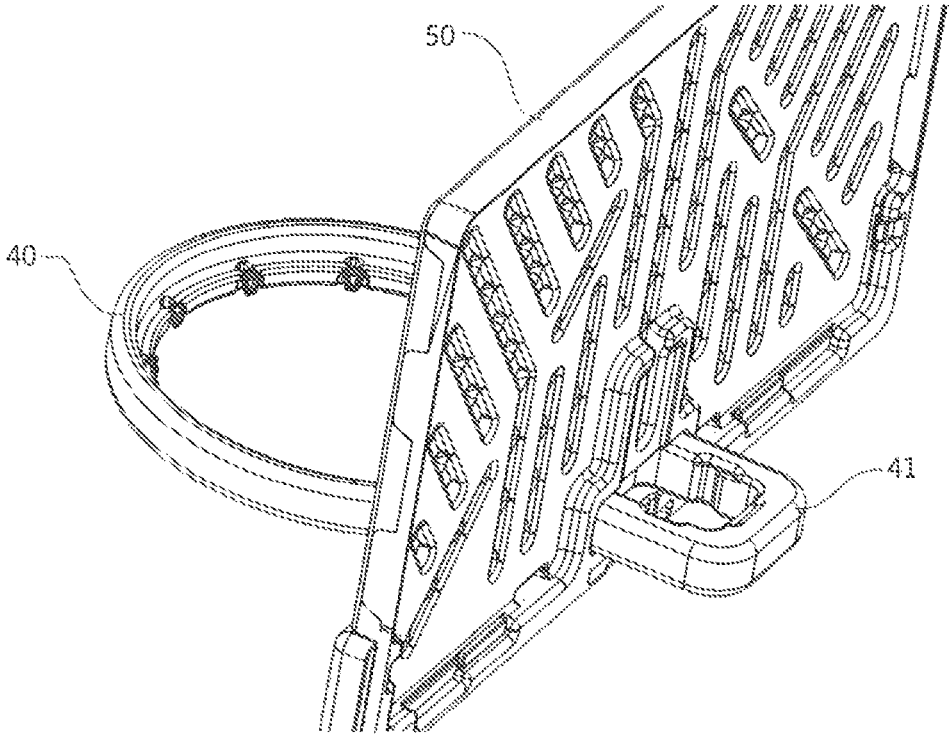
FIG. 20 is a rear perspective view of the backboard of FIG. 19 attached to the rim of FIG. 15.

The backboard 50 is configured to be removably secured to the rim 40. Preferably, the backboard 50 has a generally rectangular shape and has an opening 51, as shown in FIG. 19. The opening 51 is adapted to receive the rear section 41 of the rim 40, as shown in FIG. 20. In preferred embodiments, the rim 40 has a ridge 49, shown in FIG. 16, to prevent over-insertion of the rim 40 through the opening 51. Preferably, the backboard 50 has an appropriate width such that when the backboard 50 is secured to the rim 40, at least 70% of the hole 43 has passed through the opening 51 to permit installation of the rim/backboard assembly on the inner post 10.

Figure 22:
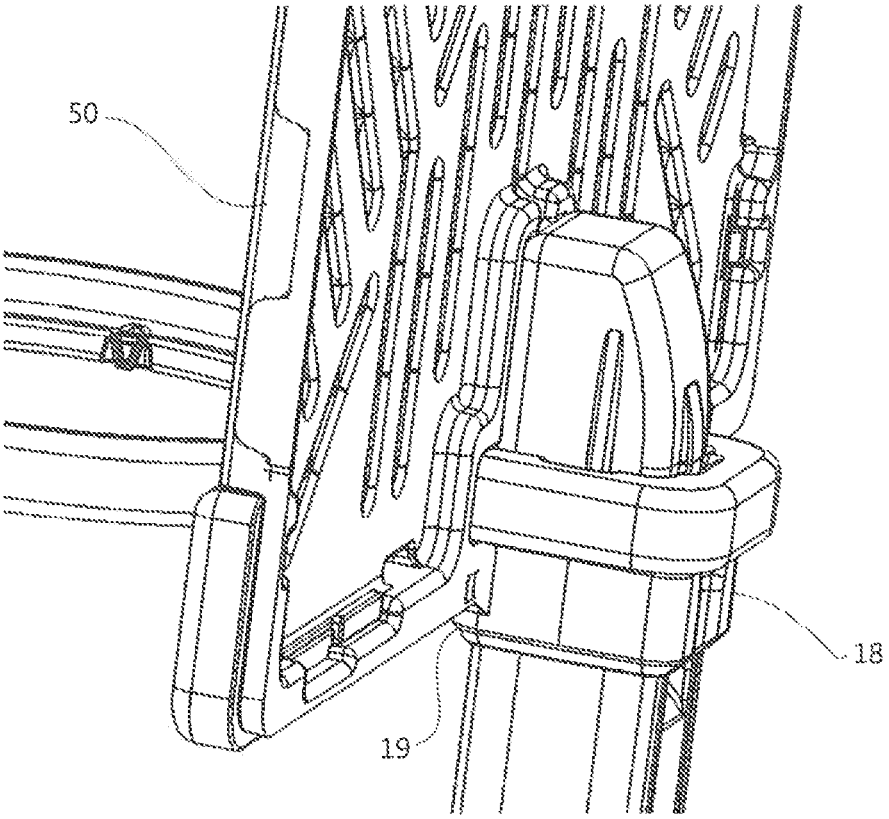
FIG. 22 is a side perspective view of the rim and backboard assembly of FIG. 20 secured to the inner post member of FIG. 3.

As depicted in FIG. 22, when the rim/backboard assembly is installed on the inner post 10, a bottom surface of the backboard 50 preferably rests the lower level 19 of the collar 18. Additionally, the top end 11 of the inner post 10 preferably bears against a rear surface of the backboard 50. Thus, the backboard 50 is supported and stabilized by its interaction with the ridge 49, the lower level 19 of the collar 18, and the top end 11 of the inner post 10. This stabilization helps minimize tilting of the backboard 50 when forces are applied to it.

Figure 17:
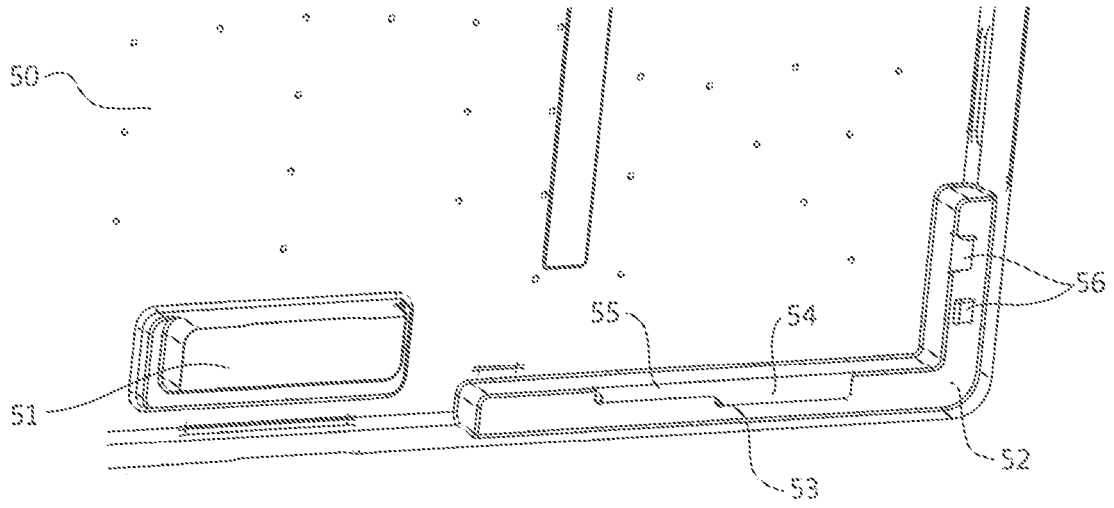
FIG. 17 is a close-up front perspective view of the backboard of the basketball set of FIG. 1 with the corner guard removed.
Figure 18:
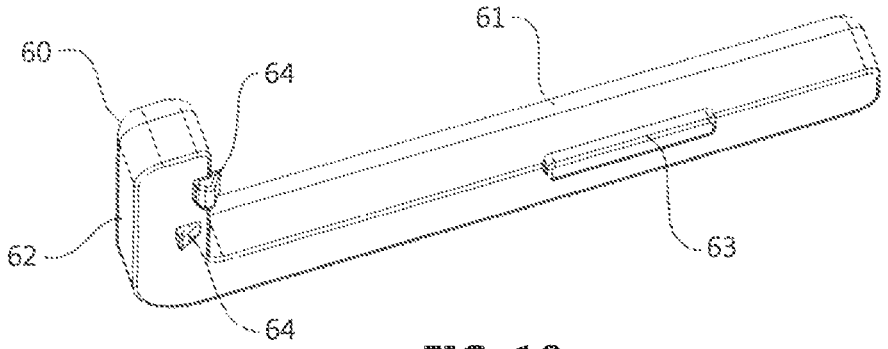
FIG. 18 is a close-up rear perspective view of the corner guard that attaches to the backboard of FIG. 17.

Preferably, the backboard 50 also includes at least one corner guard 60. In preferred embodiments, the backboard 50 includes at least two corner guards 60, located on the bottom-most corners of the backboard 50, as shown in FIG. 19. In some embodiments, the backboard 50 includes corner guards 60 on all corners of the backboard 50. As depicted in FIG. 18, the corner guard 60 preferably includes a horizontal section 61 and a vertical section 62. The corner guard 60 is configured to be removably secured to a corresponding corner edge 52, as shown in FIG. 17.

In preferred embodiments, the horizontal section 61 of the corner guard 60 includes at least one retaining bar 63 configured for insertion into a corresponding slot 53 of the backboard 50. Preferably, the slot 53 has a first pocket 54 with a height greater than the height of the retaining bar 63, and a second pocket 55 with a height equal to, or slightly greater than, the height of the retaining bar 63. Thus, the retaining bar 63 can be easily inserted into the first pocket 54 and moved toward the center of the backboard 50 into the second pocket 55 for a snug, secure fit.

Preferably, the vertical section 62 of the corner guard 60 includes at least one tab 64 configured for insertion into a corresponding recess 56 of the backboard 50. In preferred embodiments, the vertical section 62 includes at least two tabs 64. The tab 64 is preferably generally ramp shaped oriented such that the rear of the tab faces away from the center of the backboard 50. Thus, when the corner guard 60 is installed in the corner edge 52, the tab 64 drops into the corresponding recess 56 and the rear of the tab bears against a wall of the recess 56 to secure the corner guard 60 and resist its removal.

Figure 23:
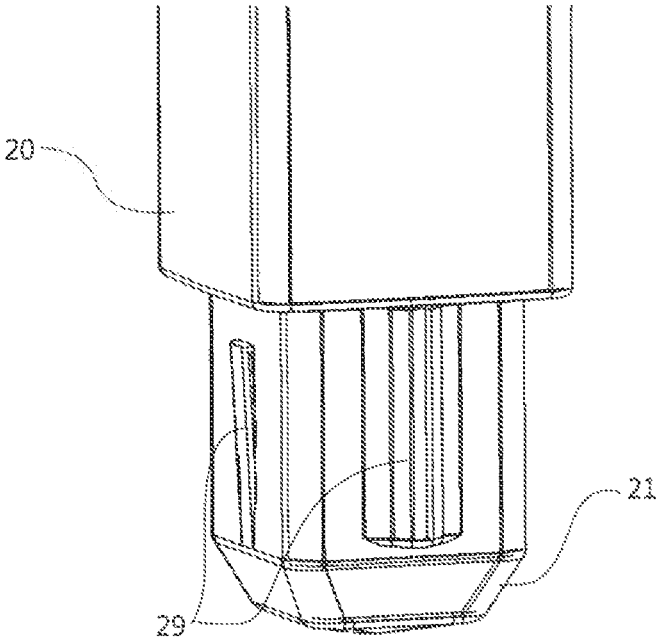
FIG. 23 is a close-up front perspective view of the outer post member of FIG. 7.
Figure 28:
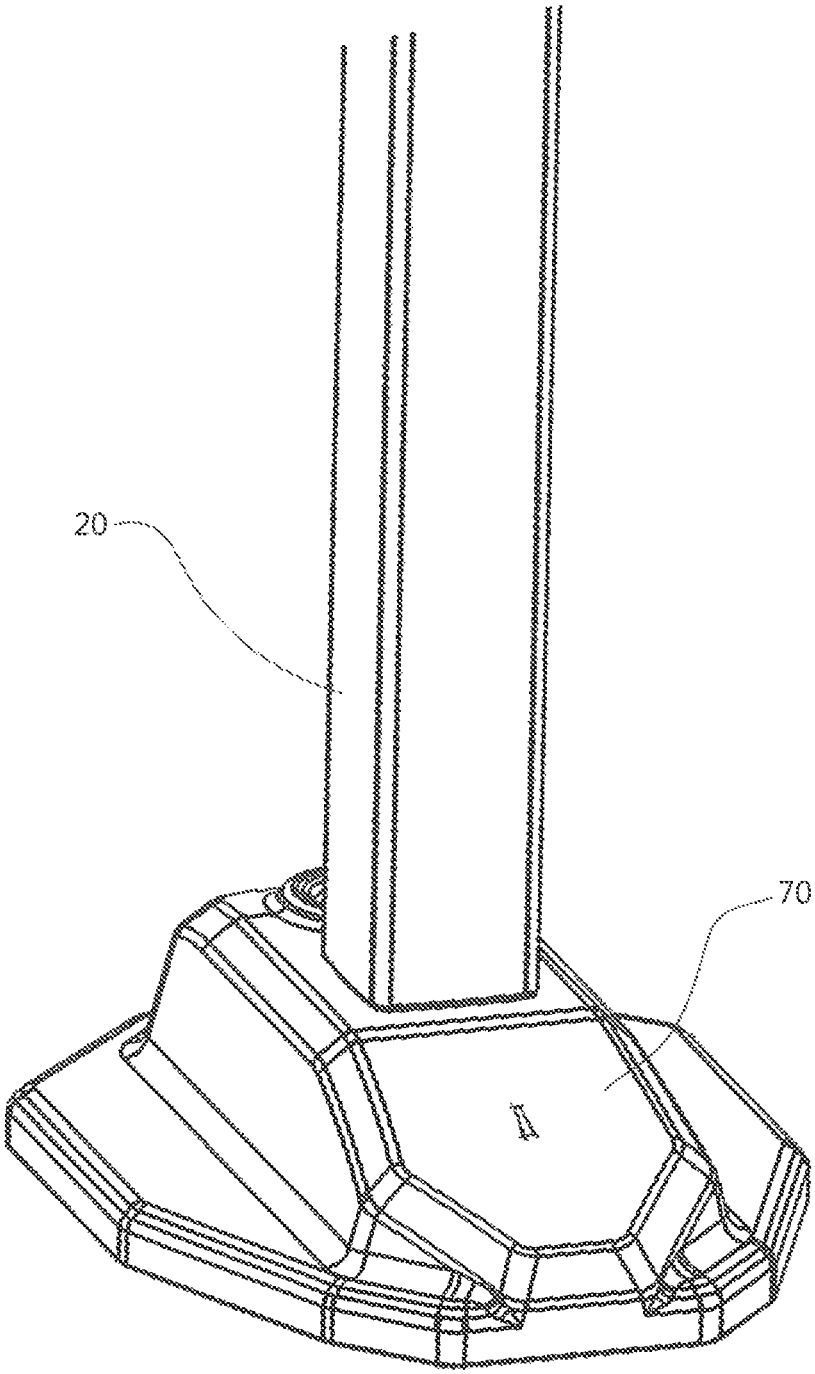
FIG. 28 is a close-up front perspective view of the outer post member and base assembly of FIG. 27.

In preferred embodiments, the outer post 20 also includes a plurality of tapered protrusions 29 positioned near the bottom closed end 21. As seen in FIG. 23, each of the plurality of tapered protrusions 29 preferably faces a different direction perpendicular to the length of the outer post 20. The bottom closed end 21 is configured to be removably secured to the base 70, as depicted in FIG. 28. The base 70 has an opening 71 adapted to receive the closed end 21 of the outer post 20, as shown in FIGS. 24-27. Preferably, the opening 71 is defined by a wall 72 having a plurality of recesses 73 that correspond to the plurality of protrusions 29 of the outer post 20. In preferred embodiments, each of the plurality of recesses 73 has a top flange 74. After the outer post 20 is attached to the base, each of the top flanges 74 rests on a top surface of the corresponding one of the plurality of tapered protrusions 29 to resist upward movement of the outer post 20.

Figure 24:
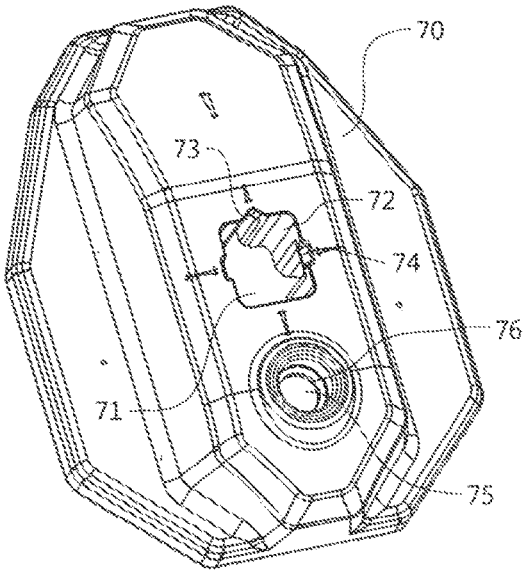
FIG. 24 is a top perspective view of the base of the basketball set of FIG. 1.
Figure 25:
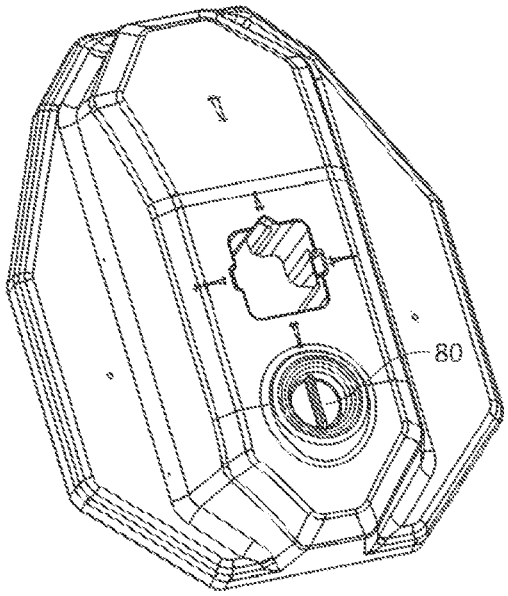
FIG. 25 is a top perspective view of the base of FIG. 24 with a plug sealing the hole to the interior cavity.
Figure 26:
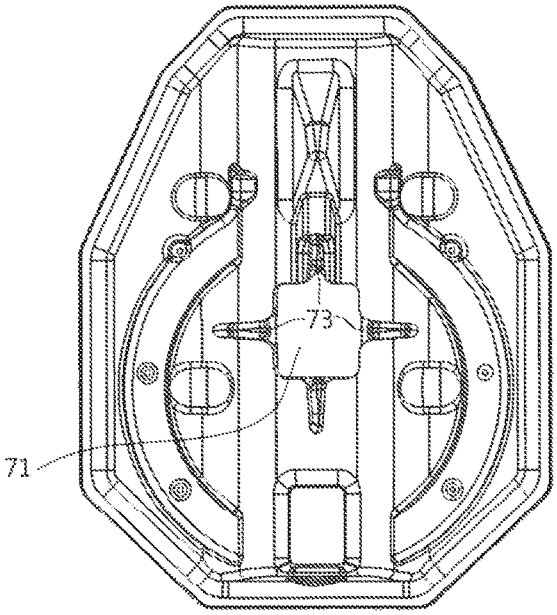
FIG. 26 is a bottom view of the base of FIG. 24.
Figure 27:
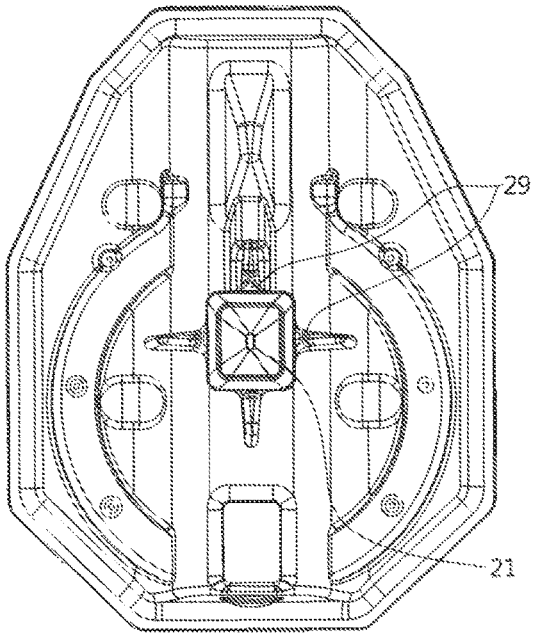
FIG. 27 is a bottom view of the base of FIG. 24 with the outer post member of FIG. 3 inserted through the opening.

In some embodiments, the base 70 also includes an interior cavity 75 that is accessible through a hole 76 in the top of the base 70, as shown in FIG. 24. The cavity 75 is configured to house additional materials, such as water, sand, gravel, etc., that may be required to add further mass and stability to the assembled basketball set 100. When the cavity 75 is sufficiently filled with the additional materials, the hole 76 is preferably sealed with a plug 80, as depicted in FIG. 25.

In preferred embodiments, each of the components described above that form the assembled basketball set 100 is a unitarily formed blow molded article. In some embodiments, a polymeric material is used to make the described components.

Although the invention has been described with reference to a particular arrangement of parts, features, and the like, these are not intended to exhaust all possible arrangements or features. Indeed, many other modifications and variations will be ascertainable to those of skill in the art.

What is claimed is:

1. A blow molded basketball goal comprising:

an inner post having a top end, a bottom end, a length measured from the top end to the bottom end, and a plurality of protrusions positioned near the bottom end of the inner post;

an outer post having a bottom end, a hollow interior defined by an interior wall, an open top end adapted to receive the inner post, and at least one protuberance on the interior wall, the at least one protuberance extends inwards into the hollow interior of the outer post and the at least one protuberance spans at least 60% of a length of the outer post;

a rim securable to the inner post; and a backboard securable to the rim;

wherein when the inner post is received in the outer post, the plurality of protrusions of the inner post bear against the interior wall of the outer post and the at least one protuberance of the outer post bears against the inner post.

2. The basketball goal of claim 1, wherein the inner post further comprises:

a plurality of recesses in a side of the inner post arranged along the length of the inner post, each of the plurality of recesses defined by at least a bottom upward-angled surface and a top surface; and the outer post further comprises: a latch having a pivot hinge and a projection, the projection of the latch corresponds to the plurality of recesses of the inner post such that the projection can be fit into any of the plurality of recesses of the inner post to lock the inner post in the outer post at a desired height.

3. The basketball goal of claim 1, wherein the at least one protuberance bears against the inner post between two of the plurality of protrusions.

4. The basketball goal of claim 1, wherein the inner post further comprises:

a plurality of tapered protrusions positioned near the top end of the inner post; and a stepped collar having a lower step configured to support a portion of the backboard, and an upper step configured to limit the positioning of the rim when securing the rim to the inner post;

wherein the stepped collar is positioned between the plurality of tapered protrusions and an upper-most recess of the plurality of recesses.

5. The basketball goal of claim 4, wherein the rim comprises:

a rear section having first hole adapted to receive the top end of the inner post, the first hole defined by a first wall having a plurality of tapered recesses corresponding to the plurality of tapered protrusions of the inner post such that the protrusions bear against the recesses to secure the rim to the inner post; and a front section having a second hole defined by a second wall having a plurality of voids and clips adapted to secure a flexible elongate material to the rim;

wherein when the rim is secured to the inner post, the upper step of the stepped collar bears against a bottom surface of the rear section of the rim such that the rim does not move down the length of the inner post when force is applied to the rim.

6. The basketball goal of claim 1, wherein the backboard comprises:

an opening adapted to receive a portion of the rim such that the backboard does not interfere with securing the rim to the inner post;

wherein when the rim is received through the opening of the backboard and secured to the inner post, a bottom surface of the backboard bears against a collar of the inner post such that the backboard does not move down the length of the inner post when force is applied to the backboard.

7. The basketball goal of claim 1, wherein the backboard comprises:

at least one removable corner member having a vertical section and a horizontal section, the horizontal section having at least one retaining bar for insertion into a corresponding slot in a corner of the backboard, the vertical section having at least one tab for insertion into a corresponding recess in the corner of the backboard.

8. The basketball goal of claim 1, further comprising:

an opening at one end of the outer post configured to receive the inner post therein, the opening comprising at least two depressions configured to respectively receive one of the plurality of protrusions and the outer and inner posts include at least one flat surface, the protuberance bearing against the flat surface of the inner post and the plurality of protrusions each bearing against one of the flat surfaces of the outer post.

9. The basketball goal of claim 1 wherein the at least one protuberance is elongated along a length of the outer post measured from the open top end to the bottom end of the outer post.

10. A kit for assembling a blow molded basketball goal comprising:

an inner post having a top end, a bottom end, a length measured from the top end to the bottom end, a plurality of protrusions positioned near the bottom end of the inner post, and a plurality of recesses arranged along the length of the inner post, each of the plurality of recesses defined by at least a bottom upward-angled surface and a top surface;

an outer post having a bottom end, a hollow interior defined by an interior wall, an open top end adapted to receive the inner post, at least one protuberance on the interior wall, and a latch having a pivot hinge and a projection, wherein the at least one protuberance spans at least 60% of a length of the outer post;

a rim securable to the inner post; and a backboard securable to the rim;

wherein when the inner post is received in the outer post, the plurality of protrusions of the inner post each bear against a flat surface of the interior wall of the outer post and the at least one protuberance of the outer post bears against the inner post;

wherein the projection of the latch corresponds to the plurality of recesses of the inner post such that the projection can be fit into any of the plurality of recesses of the inner post to lock the inner post in the outer post at a desired height.

11. The kit of claim 10, wherein the inner post further comprises:

a plurality of tapered protrusions positioned near the top end; and a stepped collar having a lower step configured to support a portion of the backboard, and an upper step configured to limit the positioning of the rim when securing the rim to the inner post;

wherein the stepped collar is positioned between the plurality of tapered protrusions and an upper-most recess of the plurality of recesses.

12. The kit of claim 11, wherein the rim comprises:

a rear section having first hole adapted to receive the top end of the inner post, the first hole defined by a first wall having a plurality of tapered recesses corresponding to the plurality of tapered protrusions of the inner post such that the protrusions bear against the recesses to secure the rim to the inner post; and a front section having a second hole defined by a second wall having a plurality of voids and clips adapted to secure a flexible elongate material to the rim;

wherein when the rim is secured to the inner post, the upper step of the stepped collar bears against a bottom surface of the rear section of the rim such that the rim does not move down the length of the inner post when force is applied to the rim.

13. The kit of claim 10, wherein the backboard comprises:

an opening adapted to receive a portion of the rim such that the backboard does not interfere with securing the rim to the inner post;

wherein when the rim is inserted through the opening of the backboard and secured to the inner post, a bottom surface of the backboard bears against a collar of the inner post such that the backboard does not move down the length of the inner post when force is applied to the backboard.

14. The kit of claim 10, wherein the backboard comprises:

at least two removable corner members having a vertical section and a horizontal section, the horizontal section having at least one retaining bar for insertion into a corresponding slot in a corner of the backboard, the vertical section having at least one tab for insertion into a corresponding recess in the corner of the backboard.

15. The kit of claim 10, further comprising:

a base having an opening to receive the bottom end of the outer post, the opening of the base defined by a wall having a plurality of tapered recesses corresponding to a plurality of tapered protrusions of the outer post positioned near the bottom end of the outer post such that the protrusions bear against the recesses to secure the outer post to the base.

16. A height adjustable post adapted to secure to a base, the post comprising:

a blow molded inner member having a top end, a bottom end, a length measured from the top end to the bottom end, and a plurality of protrusions positioned near the bottom end of the inner member;

a blow molded outer member having a bottom end, an open top end adapted to receive the inner member, a hollow interior defined by an interior wall, and at least one protuberance on the interior wall, the at least one protuberance spans at least 60% of a length of the outer post;

wherein when the inner member is received in the outer member, the plurality of protrusions of the inner member bear against the interior wall of the outer member and the at least one protuberance of the outer member bears against the inner member;

frictional forces of the at least one protuberance against the inner post and the plurality of protrusions against the interior wall are created when the inner and outer post are assembled together and the frictional forces resist axial sliding of the inner post relative to the outer post when changing a length of the post.

17. The height adjustable post of claim 16, wherein the inner member further comprises:

a plurality of recesses arranged along the length of the inner member.

18. The height adjustable post of claim 17, wherein the outer member further comprises:

a latch having a pivot hinge and a projection, the projection of the latch interacts with the plurality of recesses of the inner member such that the projection can be pivoted into any of the plurality of recesses of the inner member to secure the post at a desired height.

19. The height adjustable post of claim 17, wherein the inner member further comprises:

a plurality of tapered protrusions positioned near the top end; and a collar positioned between the plurality of tapered protrusions and an upper-most recess of the plurality of recesses, the collar configured to support a backboard assembly and prevent the backboard assembly from moving down the length of the inner member when force is applied to the backboard assembly.

20. The height adjustable post of claim 19, wherein the backboard assembly comprises:

a blow molded rim comprising:

a rear section having a first hole adapted to receive the top end of the inner member, the first hole defined by a first wall having a plurality of tapered recesses corresponding to the plurality of tapered protrusions of the inner member such that the protrusions bear against the recesses to secure the backboard assembly to the post; and a front section having a second hole defined by a second wall having a plurality of voids and clips adapted to secure a flexible elongate material to the rim; and a blow molded backboard comprising:

an opening adapted to receive a portion of the rear section of the rim such that the backboard does not interfere with receiving the top end of the inner member through the first hole of the rim; and at least two removable corner members, each of the corner members having a vertical section and a horizontal section, the horizontal section having at least one retaining bar for insertion into a corresponding slot in a corner of the backboard, the vertical section having at least one tab for insertion into a corresponding recess in the corner of the backboard.

21. The height adjustable post of claim 16, wherein the base comprises:

an opening to receive the bottom end of the outer member, the opening of the base defined by a wall having a plurality of tapered recesses corresponding to a plurality of tapered protrusions of the outer member positioned near the bottom end of the outer member such that the protrusions bear against the recesses to secure the post to the base.

22. The blow molded post of claim 16 wherein a basketball backboard and rim are attached to the inner member.

* * * * *